United States Patent [19]

Yokoyama et al.

[11] Patent Number: 4,958,599

[45] Date of Patent: Sep. 25, 1990

[54] COOLING DEVICE FOR ENGINE

[75] Inventors: Yoshiharu Yokoyama; Shigeru Akiyama, both of Iwata, Japan

[73] Assignee: Yamaha Hatsudoki Kabushiki Kaisha, Iwata, Japan

[21] Appl. No.: 405,472

[22] Filed: Sep. 11, 1989

[51] Int. Cl.[5] ..... F01P 11/20

[52] U.S. Cl. ..... 123/41.5; 138/28; 123/2

[58] Field of Search ..... 123/41.5, 2; 165/51, 165/83; 138/28

[56] References Cited

U.S. PATENT DOCUMENTS 3,208,438 9/1965 White ..... 123/41.5

FOREIGN PATENT DOCUMENTS 63-229025 9/1988 *Japan

*Primary Examiner*—Noah P. Kamen

*Attorney, Agent, or Firm*—Ernest A. Beutler

[57] ABSTRACT

A compact power supply powered by a gas fueled internal combustion engine having a liquid cooling system. The liquid cooling system includes an expandable expansion chamber device which permits a compact construction and which also permits the use of a cooling system that is devoid of any air.

6 Claims, 5 Drawing Sheets

COOLING DEVICE FOR ENGINE

BACKGROUND OF THE INVENTION

This invention relates to a cooling device for an engine and more particularly to an improved, simplified and compact expansion chamber arrangement for the liquid coolant of a liquid cooled internal combustion engine.

Many forms of internal combustion engines are cooled by liquid cooling systems that include a cooling jacket for the engine, a heat exchanger for exchanging heat from the liquid coolant of the engine to the surrounding atmosphere and conduits and a circulating arrangement for circulating the coolant between the heat exchanger and the engine cooling jacket. As is well known, the coolant temperature can vary quite widely during operation and when the engine is not being run. Ambient temperatures can reach quite low temperatures and the normal operating temperature of the engine is substantially above ambient and may be near or even above the boiling point of water. That is, it is the frequent practice to use a coolant that is other than pure water and to pressurize the cooling system so that the boiling point will be raised even further. The efficiency of the engine and its cooling system can be increased if the operating temperature of the cooling system is above the boiling point of water. Of course, these extreme variations in coolant temperature can give rise to substantial volume changes in the coolant. It has, therefore, been the practice to provide an expansion chamber which communicates with the main cooling system and into which excess fluid can be displaced as the fluid is heated. When the system cools back down, the coolant will flow from the expansion chamber back into the main cooling system. Although such devices are obviously advantageous, the volume of the expansion chamber must be adequate to assure that it can contain the total and maximum anticipated excess volume. As a result, the size of the expansion chamber may in many instances be larger than actually required due to the fact that the ambient temperature may not be as low as the maximum design low temperature. Although with such engine applications as in powering motor vehicles this is satisfactory, in many other applications the use of such large expansion chambers can be disadvantageous. Also the use of fixed volume expansion chambers means that air must be present in contact with the coolant which is not always desirable.

It is, therefore, a principle object of this invention to provide an improved cooling system for internal combustion engines.

It is a further object of this invention to provide a variable volume expansion chamber for a liquid cooled internal combustion engine.

SUMMARY OF THE INVENTION

This invention is adapted to be embodied in a cooling system for an internal combustion engine having a cooling jacket. A heat exchanger is provided and conduit means communicate liquid flow between the engine cooling jacket and the heat exchanger. In accordance with the invention, an elastic expansion chamber communicates with the cooling system for receiving and containing varying volumes of coolant as the coolant expands and contracts due to temperature variation.

DETAILED DESCRIPTION OF THE PREFERRED EMBODIMENTS OF THE INVENTION

Figure 1:
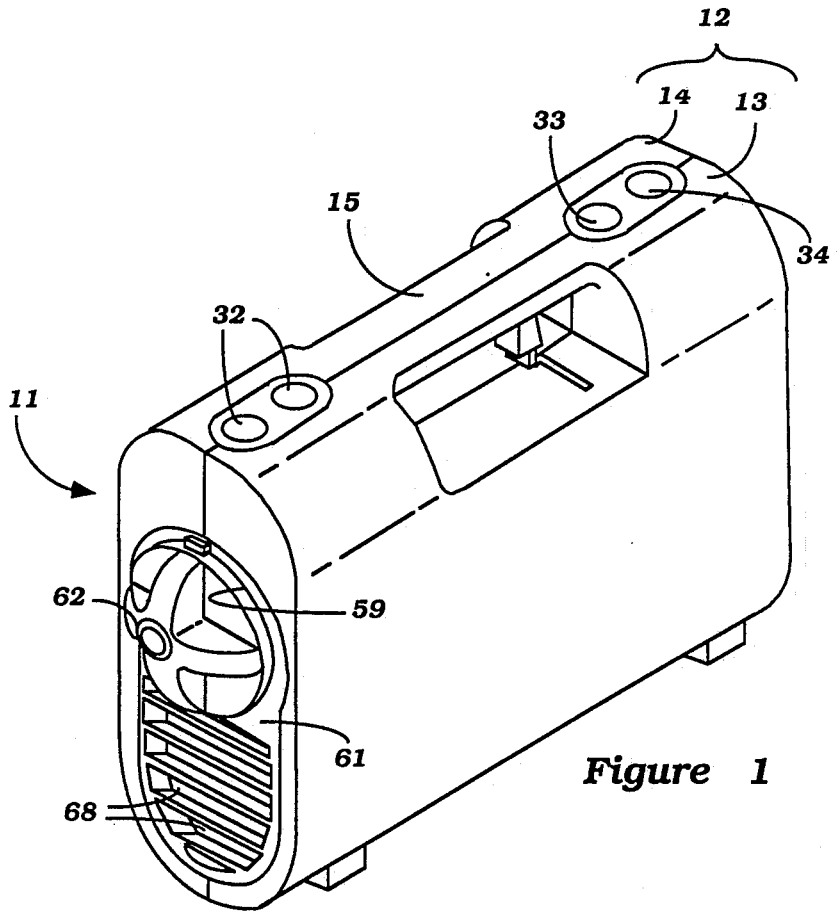
FIG. 1 is a perspective view of a portable power supply incorporating internal combustion engine having a cooling system constructed in accordance with an embodiment of the invention.
Figure 2:
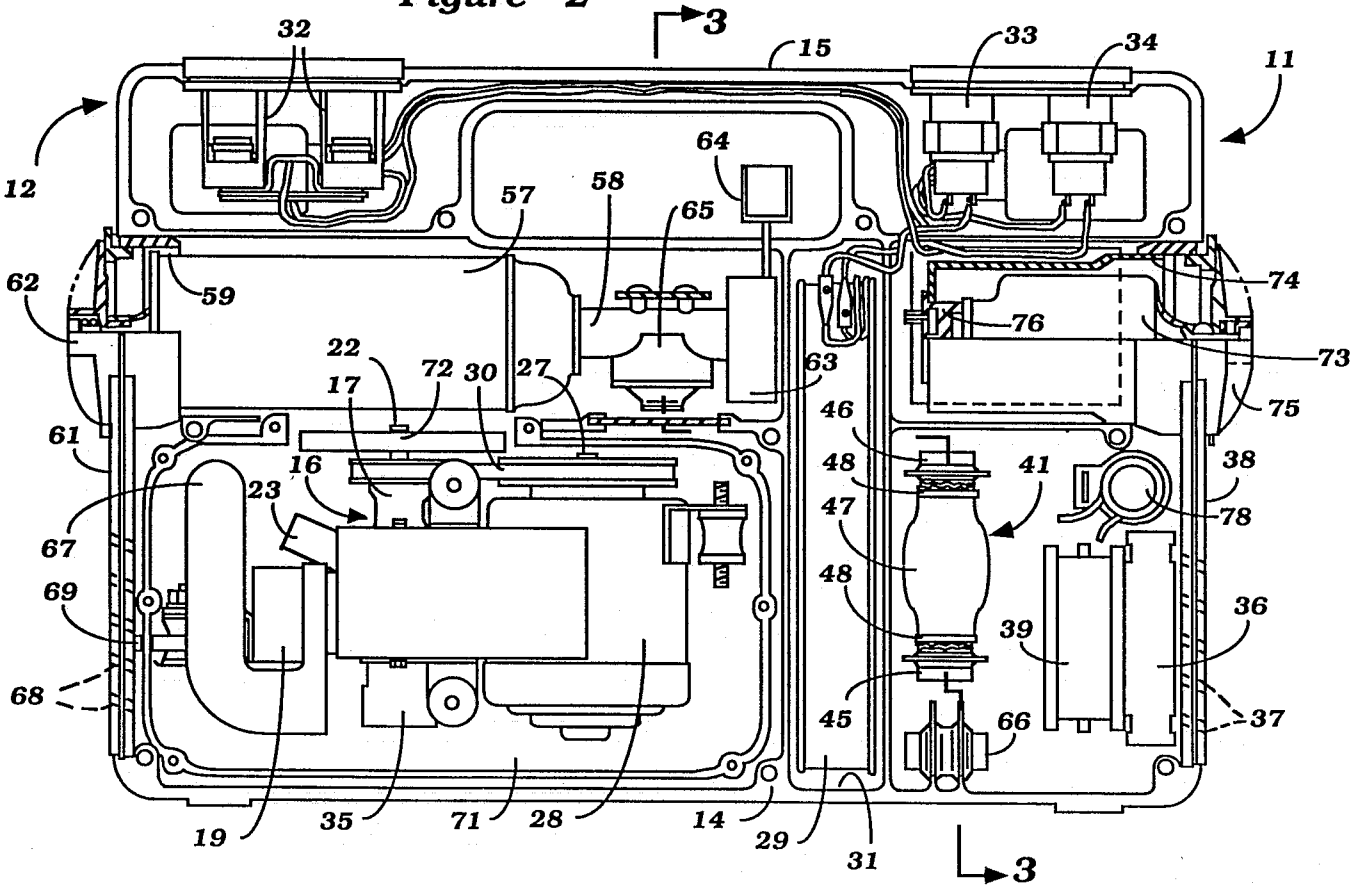
FIG. 2 is a side elevational view, with portions broken away, showing the interior construction of the power supply.
Figure 3:
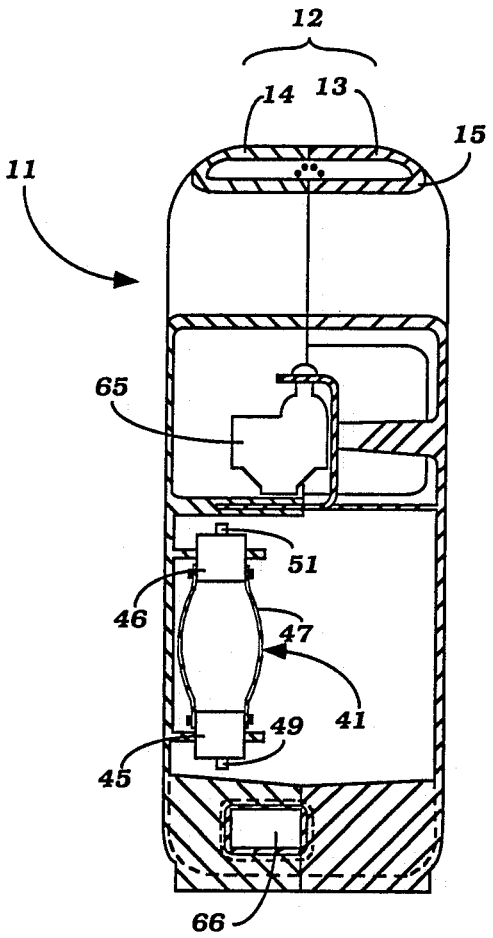
FIG. 3 is a cross sectional view taken along the line 3—3 of FIG. 2.

Referring first primarily to FIGS. 1 through 3, a compact portable electric power supply constructed in accordance with an embodiment of the invention is identified generally by the reference numeral 11. The invention is described in conjunction with such a compact portable electric power supply only by way of example because the invention is capable of use in many other applications. However, the invention has particular utility in such power supplies because it has particular utility in providing a very compact cooling system for an internal combustion engine. The power unit 11 is comprised of an outer housing, indicated generally by the reference numeral 12, and which contains all of the components of the power supply. The outer housing 12 may be formed form any suitable material such as two mating pieces 13 and 14 each formed from a molded plastic and is formed with a carrying handle 15 formed by an opening at its upper end.

Contained with the outer housing 12 is a single cylinder, liquid cooled, small displacement internal combustion engine, indicated generally by the reference numeral 16. In the illustrated embodiment, the engine 18 (see also FIG. 4) is operated under the two-stroke, crankcase compression principle, however, it should be readily apparent to those skilled in the art that the engine 16 may be a four-stroke cycle engine and may have other than a single cylinder and, in fact, may be a rotary or other type of engine than a reciprocating engine.

Figure 4:
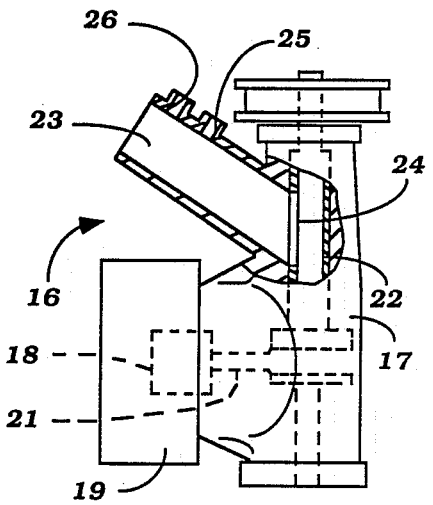
FIG. 4 is a side elevational view, with a portion broken away, of the internal combustion engine.

Referring specifically to FIG. 4, the engine 16 is formed with a unitary crankcase cylinder block assembly 17 that forms a single cylinder bore in which a piston 18 is supported for reciprocation. A cylinder head 19 is affixed to the assembly 17 and completes the formation of the combustion chamber. The piston 18 is connected by means of a connecting rod 21 to a crankshaft 22 that is journaled in the assembly 17 in a known manner.

An intake passageway 23 is formed in the assembly 17 and supplies a fuel air charge to the crankcase of the engine through a rotary type valve 24. This charge is transferred to the combustion chamber in a known manner. The intake charge includes air drawn through the passageway 23 and a gaseous form of fuel which is delivered to the intake passageway 23 through a port 25. In addition, a further port 26 is provided for admitting lubricant to the intake passage 23 for lubrication of the engine. The fuel supply and lubricant supply system for the engine will be described later.

The engine 16 has its crankshaft 22 connected to a shaft 27 of a combined starter and generator 28 by means of a driving belt 30. The starter, generator 28 is coupled with an electrical circuit that includes a vertically positioned battery 29 contained within a compartment 31 formed by the outer housing 12. This circuit permits the starter, generator 28 to operate as a starter so as to start the engine 16. Once the engine 16 commences running, the starter, generator 28 will operate as a generator and supply a charge to the battery 29 and also provide an electrical output to a pair of receptacles 32 carried adjacent the handle 15 so as to permit electrical devices to be plugged in and powered by the unit 11.

There is provided adjacent the handle 15 on the side opposite the receptacles 32 a main control switch 33 for switching the power on and off and a starter switch 34 for operating the starter, generator 28 in its starter mode.

Figure 5:
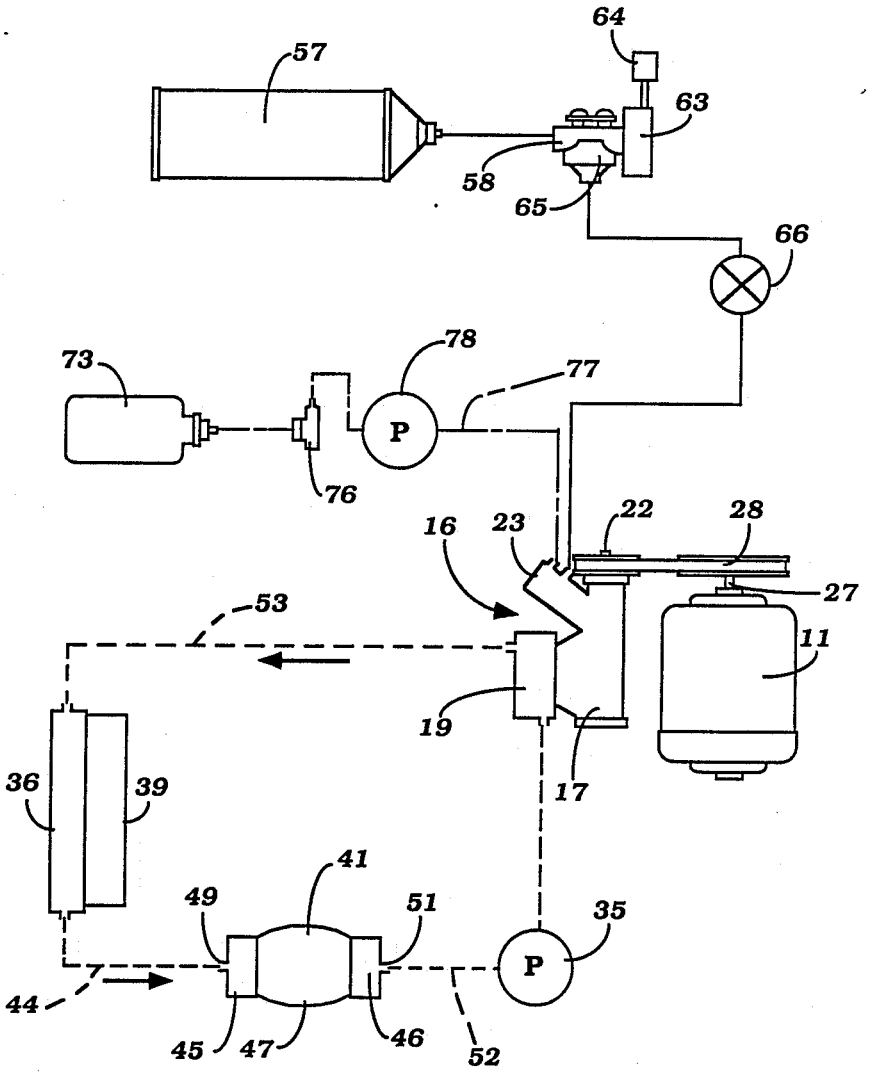
FIG. 5 is a schematic view showing the construction of the various components of the power supply.

The engine 16 is further provided with a cooling system (FIGS. 5–7) embodying the invention that includes a coolant pump 35 that is driven by the engine 16 and which circulates coolant through a cooling jacket of the engine and a heat exchanging radiator 36. The radiator 36 is juxtaposed to an air inlet opening 37 formed in an end plate 38 at one side of the housing 12. There is further provided an electric fan 39 that is powered by the battery 29 and which circulates the air across the core of the radiator 36. The cooling system also includes an accumulator type pressure control and expansion chamber device 41 which is comprised generally of an expansible hose section to be described so as to compensate for volume differences in the coolant of the engine 16 as occur during engine operation.

Figure 6:
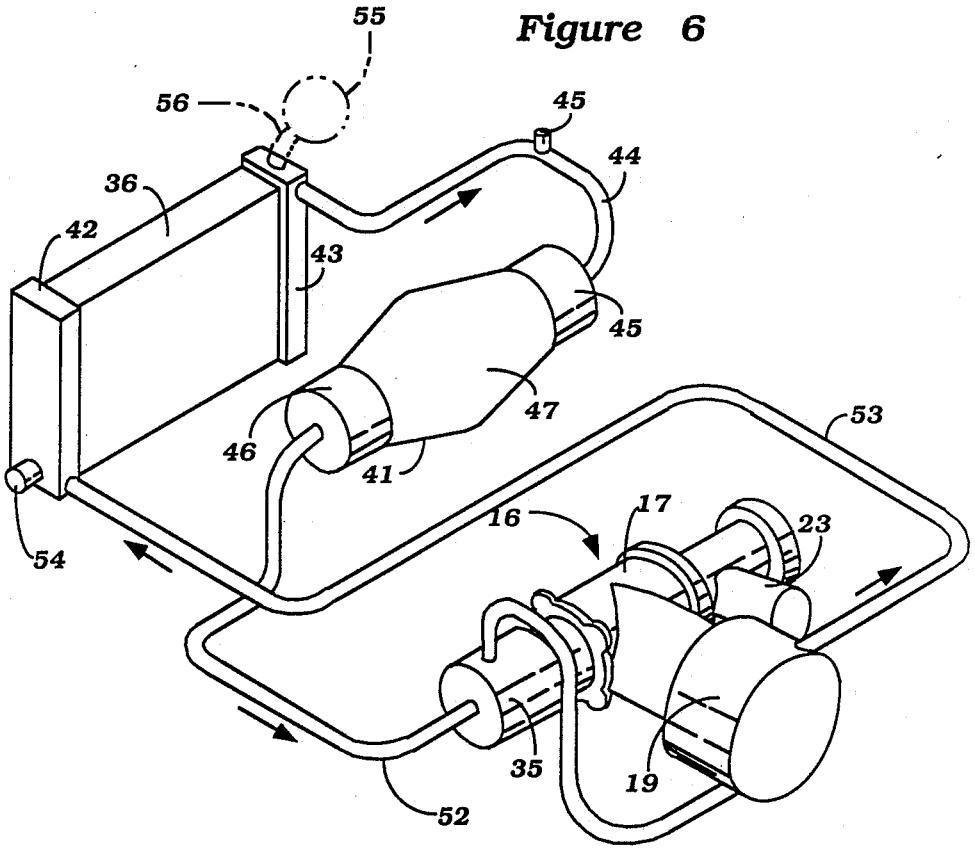
FIG. 6 is an enlarged perspective view showing the cooling system for the powering internal combustion engine.
Figure 7:
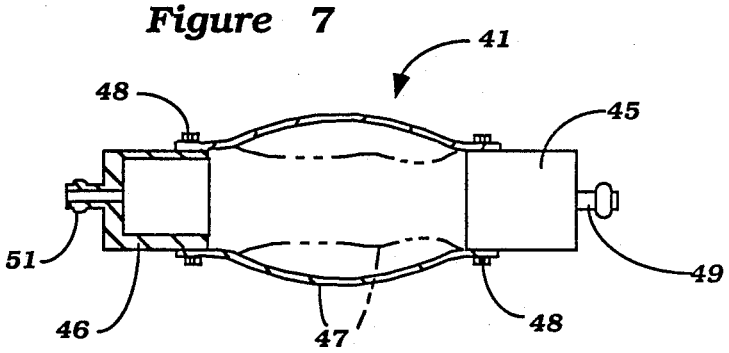
FIG. 7 is an enlarged cross sectional view of the expansion device.

As may be seen in FIG. 6, the radiator 36 is of the cross flow type and includes header tanks 42 and 43. A conduit 44 extends from the header tank 42 to the expansion chamber device 41. An air bleed and fill port 45 is provided in the conduit 44 for filling the system and bleeding air.

The expansion chamber device 41 (FIG. 7) includes a pair of rigid end pieces 45 and 46. A rubber or elastomeric hose 47 is held to these end pieces by means of a pair of hose clamps 48. The end piece 45 is formed with an inlet nipple 49 that communicates with the conduit 44 so as to admit liquid coolant to the expansion device 41.

An outlet nipple 51 extends from the end piece 46 and is connected to a conduit 52 that leads to the inlet side of the coolant pump 35. A return conduit 53 extends from the outlet of the engine cooling jacket to the header tank 42 of the radiator 36. A drain valve 54 is provided in the header tank 42 for draining the lubricant system.

The expansible member 47 has sufficient flexibility so as to contract between a phantom line position when the coolant is at its lowest expected temperature and an expanded position as shown in the solid line view when the coolant is heated to its maximum temperature so as to provide a pressure in the system and also so as to accommodate the variations in fluid volume as may occur with temperature changes. As a result, the expansion chamber can occupy a minimum amount of space and yet provide the necessary functions for such expansion chambers. In the illustrated embodiment, the expansion device is provided directly in one of the conduits for the cooling system.

As an alternative construction, a separate expansion device 55 may communicate with one of the header tanks, for example the tank 43 through a conduit 56. Of course, this alternative expansion device 55 may communicate with the header tank 42 and also the expansion device 41 may be provided in the return line 53 rather than in the supply line 44.

The engine 16 is fueled by a pressurized source of gaseous fuel (LPG) that is contained within a removable container 57 that is detachable connected to a receptacle 58 immediately beneath the handle portion 15. The container 57 is placed into the receptacle 58 through an opening 59 formed an end plate 61 at one side of the housing 12 and which opening is normally closed by a closure plug 62.

The receptacle 58 is coupled to main shutoff valve 63 having a control handle 64 so as to permit the supply of fuel from the container 28 to be shut off from the remainder of the fuel supply circuit for the engine when the power supply 11 is not being utilized. The receptacle 58 also includes a pressure regulator 65.

A conduit connects the pressure regulator 65 with a duty solenoid valve 66 which controls the flow of fuel to the induction system of the engine 16 in a manner as described in the copending patent application entitled "Gas Engine", Ser. No. 377,419, filed July 10, 1989, and assigned to the assignee of this application. The disclosure of that application is incorporated herein by reference.

The engine 16 further includes an exhaust system that is comprised of a muffler 67 that is juxtaposed to an air outlet opening 68 which is formed in the end plate 61 at the side of the housing 12 opposite to the inlet opening 37. Air which has passed across the engine will then exit from the air outlet opening 68 so as to cool the muffler 67. The muffler 67 also has a discharge opening 69 which registers with the opening 68 for discharge of exhaust gases from within the housing 12.

The engine 16 and generator 28 are contained within a main cavity 71 formed by the outer housing 12. An engine driven fan 72 circulates air from within the housing 12 across the engine 16, muffler 67 and the opening 68.

The engine 16 is also provided with a lubricating system (see mainly FIG. 5) that receives lubricant from a separate lubricant container 73 that is received within a compartment 74 formed in the outer housing 12 and which is closed by a removable closure plug 75. The lubricant container 73 is of the cartridge type and is connected to a receiver 76 that supplies lubricant to the engine induction system through a conduit, shown schematically at 77 and in which a lubricant control pump 78 is positioned. The lubricant pump 78 is designed so as to provide a positive flow of lubricant and also will in effect close the conduit 77 when the engine is not running so that lubricant cannot inadvertently flow from the reservoir 73 to the engine 16. The pump 78 also meters a very small amount of lubricant in a manner as will be described in the copending application entitled "Lubricant Affording Device", Ser. No. 377,480, filed July 10, 1989, and assigned to the Assignee of this application.

It should be readily apparent from the foregoing description that the described construction provides a very compact power supply system which is possible in part because of the use of the highly effective cooling system that can have a very compact construction due to the use of the flexible expansion chamber. The use of the flexible expansion chamber, in addition to providing a compact assembly, also permits all air to be excluded from the cooling system unlike arrangements wherein fixed volume expansion chambers are employed. With such fixed volume chambers, there must be an air space to allow for the fluid expansion and thus there is always the risk that air can become entrapped in the coolant to decrease the efficiency of the cooling system. With the present construction, on other hand, this problem is not possible because there is no air in the system. Although a number of embodiments of the invention have been illustrated and/or described, it is to be understood that various changes and modifications may be made without departing from the spirit and scope of the invention, as defined by the appended claims.

We claim:

1. In a cooling system for an internal combustion engine mounted within a casing and powering an electrical generator, said internal combustion engine having a cooling jacket, a heat exchanger, conduit means for communicating liquid flow between said engine cooling jacket and said heat exchanger, the improvement comprising an elastic expansion chamber supported directly by said casing and communicating said cooling system for receiving and containing the varying volumes of coolant as the coolant expands and contracts due to temperature variations.

2. In a cooling system for an internal combustion engine as set forth in claim 1 wherein no air is present in the expansion chamber above the fluid level therein.

3. In a cooling system for an internal combustion engine as set forth in claim 1 wherein the expansion chamber forms a portion of the conduit means.

4. In a cooling system for an internal combustion engine as set forth in claim 3 wherein the expansion chamber comprises a pair of fittings adapted to receive other portions of the conduit and an expandable hose section.

5. In a cooling system for an internal combustion engine as set forth in claim 4 wherein the cooling system is devoid of any air.

6. In a cooling system for an internal combustion engine as set forth in claim 1 wherein the heat exchanger has a core and at least one tank and wherein the expansion chamber communicates with the tank through a conduit.

* * * * *